US005241718A

United States Patent [19]

Pope

[11] Patent Number: 5,241,718

[45] Date of Patent: Sep. 7, 1993

[54] BUMPER PAD FOR INFANT CRIB

[76] Inventor: Cheryl D. Pope, 2046 E. Chelsa Ct., Highlands Ranch, Colo. 80126

[21] Appl. No.: 959,116

[22] Filed: Oct. 9, 1992

[51] Int. Cl.[5] ..... A47D 15/00

[52] U.S. Cl. ..... 5/424; 5/93.1

[58] Field of Search ..... 5/93.1, 424, 425, 658, 5/663; 248/345.1

[56] References Cited

U.S. PATENT DOCUMENTS

| | | | |
|---|---|---|---|
| 949,389 | 2/1910 | Almgren | 5/93.1 |
| 2,128,978 | 9/1938 | Akin | 5/93.1 |
| 3,018,492 | 1/1962 | Rosen | 5/93.1 |
| 3,137,870 | 6/1964 | Fink | 5/93.1 |
| 4,800,600 | 1/1989 | Banu | 5/93.1 |

FOREIGN PATENT DOCUMENTS

| | | | |
|---|---|---|---|
| 713158 | 8/1954 | United Kingdom | 5/93.1 |

*Primary Examiner*—Michael F. Trettel

*Attorney, Agent, or Firm*—Edwin H. Crabtree; Donald W. Margolis

[57] ABSTRACT

A bumper pad for receipt inside an infant crib and attachment to vertical slats and vertical corner posts of the crib and around the interior perimeter of the crib. The bumper pad designed to protect babies, infants and small children when using the crib. The bumper pad includes an elongated interior side and an oppositely disposed exterior side. An upper portion and a lower portion of the interior and exterior sides are joined together to form a void therebetween. The void is used for receiving padding material therein. The interior and exterior sides are made of a soft fabric material. The pad includes a first end which is releasably secured to a second end of the pad forming a closed loop. A plurality of flaps are incorporated into the exterior side of the pad. The flaps are disposed in a spaced relationship to each other around the exterior side of the pad. The flaps are used to wrap around a portion of the crib's slats and corner posts for securing the pad to the crib and adjacent the mattress of the crib. The exterior flaps are out of sight from the child in the crib therefore preventing the child from playing with the flaps, sticking the flaps in his or her mouth, and preventing the infant from possibly removing the pad from the sides of the crib.

18 Claims, 2 Drawing Sheets

BUMPER PAD FOR INFANT CRIB

BACKGROUND OF INVENTION (a) Field of the Invention

This invention relates to a bumper pad and more particularly, but not by way of limitation, to a bumper pad used for mounting inside an infant crib to protect babies, infants, and small children when using the crib.

(b) Discussion of Prior Art

Heretofore there have been a variety of different types of bumper pads designed to prevent the bumping of an infant against hard wooden or metal rails and slats that help form a crib. The bumper pads have been generally held by strings or ties secured to the vertical slats, side rails and head and footboards of the crib. The ties are not satisfactory because they can easily be loosened by the infant and the pad removed from the crib. Also, the ties can be pulled free from the pad with the ties becoming play things for the child to stick in his or her mouth running a risk of possibly choking the infant. Further ties, by virtue of being in sight of the child, entice the child to play with the ties and digits, i.e. toes and fingers, can become entangled endangering the safety of the infant. Still further, when and if the child tears off the ties, the padding material therein will quite often come free from the bumper pad making the pad unsightly and causing the pad to be replaced.

In U.S. Pat. No. 4,670,923 to Gabriel et al., U.S. Pat. No. 3,619,824 to Doyle and U.S. Pat. No. 3,241,158 to Berl different types of crib bumpers, crib liners and transparent bumper pads are shown. None of these prior art patents disclose the unique structure and advantages of the subject invention as described herein when addressing the above mentioned problem of the use of bumper pad ties and their attraction to playful children

SUMMARY OF THE INVENTION

In view of the foregoing, it is an object of the present invention to provide a bumper pad for an infant crib that can be quickly secured and conveniently removed from an interior perimeter of the crib for washing or cleaning. The pad eliminates the use of independent sewn-on ties attached to an upper portion of the bumper pad which heretofore were attracted to a child. Through the use of integrated flaps in the facing material of the exterior side of the pad, the flaps can to be torn free from the sides of the pad.

Another object of the invention is to provide a bumper pad that can be used with a variety of different types and sizes of baby cribs and play pens and secured thereto with out running a risk that the child can remove the pad therefrom.

Still another object of the subject bumper pad is to provide a safe, high quality, streamlined and washable pad that protects a child from bumping his or her head or body against hard slats, corner posts and head and footboards of the infant bed. Also the bumper pad is secured to the crib adjacent the sides of the bed mattress to prevent the child from sticking an arm or leg between and through the vertical slats of the cribs or losing a baby bottle or baby toy therebetween.

A further object and an extremely important object of the invention is the subject bumper pad integrates a plurality of flaps in the facing material of the exterior side of the pad and disposed in a spaced relationship to each other on the exterior side of the pad. The flaps are used for securing the pad to the vertical slats and corner posts of the crib. The flaps are out of sight from a child playing in the crib therefore provide no physical attraction to the child.

The subject bumper pad includes an elongated interior side and an oppositely disposed elongated exterior side. An upper portion and a lower portion of the interior and exterior sides are joined together to form a void therebetween. The void is used for receiving padding material therein. The interior and exterior sides are made of a soft fabric material. The pad includes a first end which is releasably secured to a second end of the pad forming a closed loop. A plurality of flaps are integrated in a portion of the fabric facing material in the exterior side of the pad. The flaps are disposed in a spaced relationship to each other around the exterior side of the pad. The flaps are used to wrap around a portion of the crib's slats and corner posts for securing the pad to the crib and adjacent the mattress of the crib. As mentioned above, the exterior flaps are out of sight from the child in the crib therefore preventing the child from playing with the flaps, sticking the flaps in his or her mouth, and preventing the infant from possibly removing the pad from the sides of the crib.

These and other objects of the present invention will become apparent to those familiar with bedding materials, mattresses, liners and bumper pads used with baby cribs from the following detailed description, showing novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and which.

DESCRIPTION OF THE PREFERRED EMBODIMENTS

Figure 1:
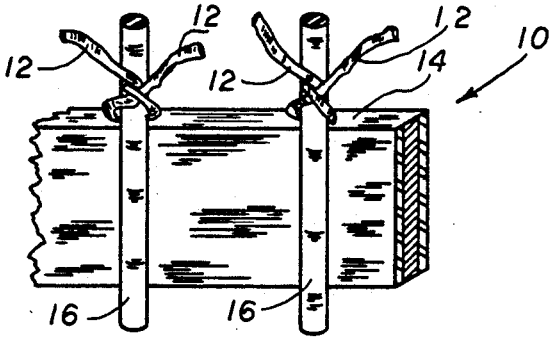
FIG 1 PRIOR ART
FIG. 1 is a front view of a portion of a prior art bumper pad for an infant crib and shown attached to a pair of vertical slats of the crib.

In FIG. 1, a front view is shown of a portion of a typical prior art infant crib bumper pad 10 having a plurality of ties 12 attached to a top portion 14 of the pad 10. The ties 12 are wrapped around part of a crib's vertical slats 16 and tied thereto. As mentioned above, the ties 12 are an attraction to an active child who will play with the ties 12, stick the ties 12 in his or her mouth, pull or tear the ties 12 free from the pad 10 and loosen and possibly remove the ties 12 and pad 10 from the sides of the crib.

Figure 2:
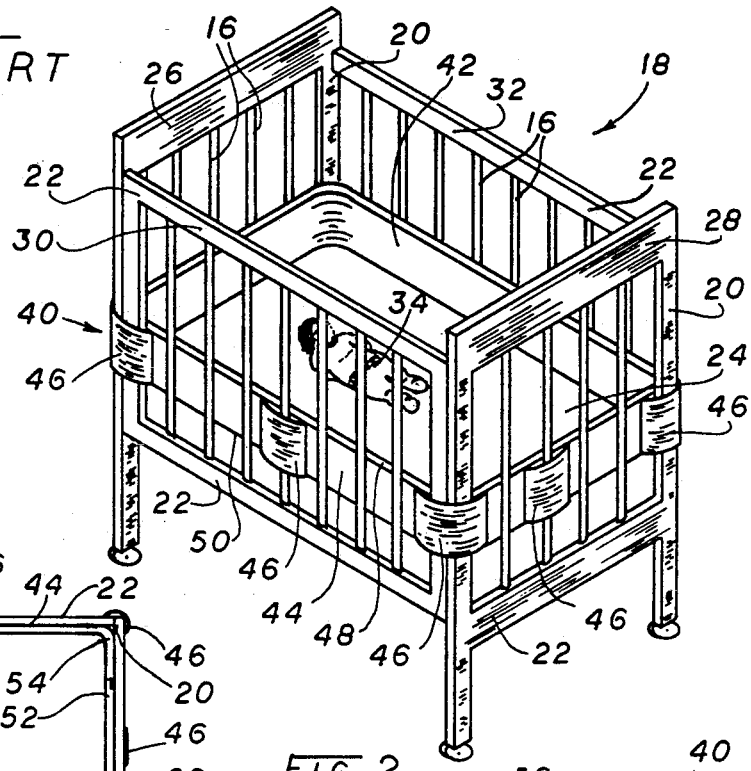
FIG. 2 is a perspective view of an infant crib illustrating the subject invention secured around the inside perimeter of the crib.

FIG. 2 illustrates a perspective view of an infant crib 18 with the vertical slats 16, corner posts 20, horizontal rails 22, a mattress 24, a head end 26, a rear end 28, a front side 30 and a rear side 32. In this drawing a sleeping baby 34 is shown centered on top of the mattress 24. While this crib 18 is shown with slats 16 and corner posts 20, a crib with a headboard and footboard could also be shown using the subject invention. Also, the invention can easily be adapted for playpens, cradles and the like and provide the objects and advantages equally well as described herein. The bumper pad as shown in this figure is designated by general reference 40 and is shown installed around a perimeter of the inside of the crib and adjacent the sides of the mattress 24. The pad 40 includes an elongated interior side 42 and an oppositely disposed elongated exterior side 44. Extending outwardly from the exterior side 44 and in a spaced relationship to each other are a plurality of flaps 46 which are received around a portion of the corner posts 20 and a portion of one of the vertical slats 16 at the head and rear ends 26 and 28 and the front and rear sides 30 and 32 of the crib 18. Note, the flaps 46 are not exposed to a child inside the crib 18, and the only portion of the pad 40 seen by the child is the interior side 42 and a top portion 48 of the pad 40. A bottom portion 50 of the pad 40 is disposed on top of the sides of the mattress 24. While one or more flaps 46 might be adequate to hold the pad 40 in place, it has been found that to firmly hold the pad 40 in place around the inner perimeter of the crib 18, there should be flaps 46 secured to the corner posts 20 and one of the slats 16 on each side of the crib 18.

Figure 3:
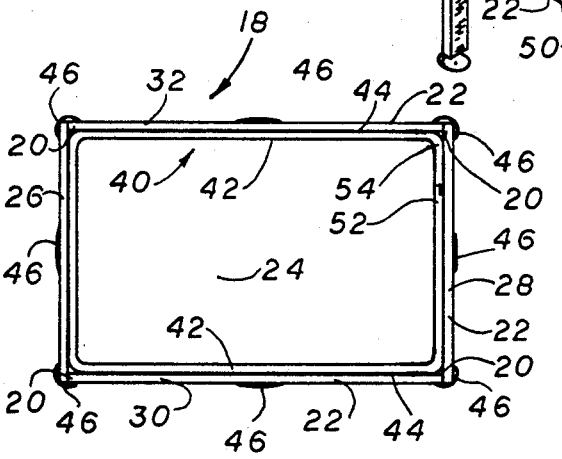
FIG. 3 is a top view of the invention wherein a plurality of flaps of the bumper pad are wrapped around a portion of the crib's vertical slats and corner posts.
Figure 9:
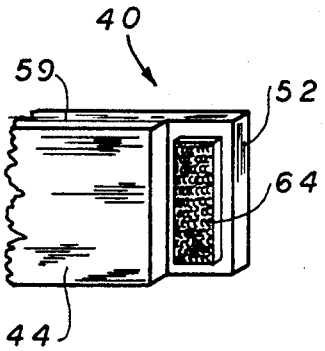
FIG. 9 is a perspective view of a first and a second end of the bumper pad in a ready position for securing the ends together.
Figure 9:
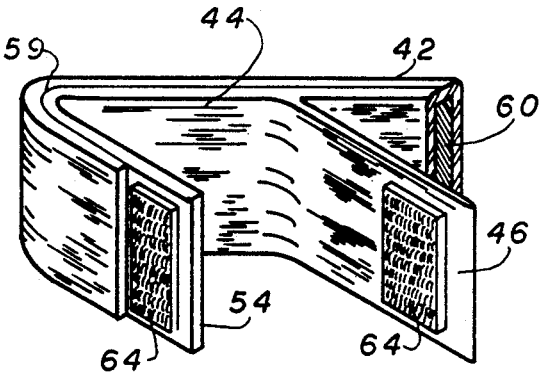

In FIG. 3 a top view of the novel bumper pad 40 is shown secured around the inner perimeter of the crib 18. In this view the top of the flaps 46 are shown received around the corner posts 20 and vertical slats 16. The pad 40 includes a first end 52 releasably secured to a second end 54. The detailed structure of the two ends 52 and 54 and how they are attached is shown in FIG. 9.

Figure 4:
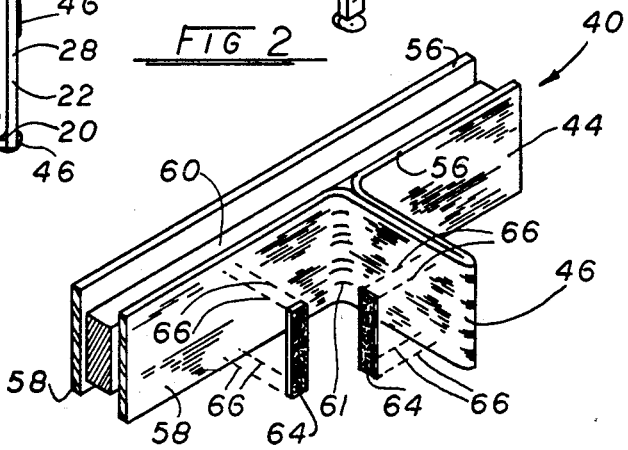
FIG. 4 is a perspective view of a portion of the bumper pad prior to assembly.

In FIG. 4 a perspective view of a portion of the pad 40 is shown prior to assembly. During assembly, an upper portion 56 and a lower portion 58 of the interior and exterior sides 42 and 44 are sewn together forming a void therebetween for receiving padding 60 therebetween. When the sides are sewn together, a seam 59 is formed and shown as a line in FIGS. 5–10. The sides 42 and 44 can be made of a soft fabric facing material such as cotton, a polyester blend and like materials. The padding 60 may be made of a foam rubber, a foam plastic and similar padding materials. The padding 60 may be enclosed between the sides 42 and 44 during the sewing operation or inserted therein after the sides are secured to each other. Also, during the assembly operation portions of the exterior side 44 are gathered in a folded loop at spaced intervals forming spaced apart flaps 46 integrated into the exterior side 44, as shown in this drawing. Each flap 46 is then stitched along it's vertical width adjacent a fold 61 in the exterior side 44. The stitching is shown as dotted lines 62 in FIGS. 5 and 6.

To secure the flap 46 to part of the exterior side 44 strips of hook and loop attachments may be used. This material is commonly called by it's tradename "Velcro". The mark is owned by American Velcro Company of New York, N.Y. Strips 64 of the attachment material are shown in position, as indicated by dotted lines 66, for securing to the flap 46 and the exterior side 44.

Figure 5:
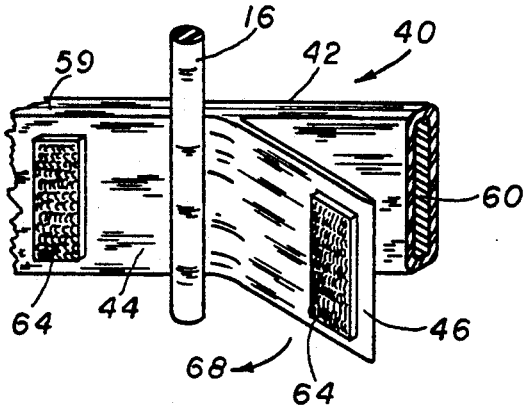
FIG. 5 and FIG. 6 are perspective views of a portion of the bumper pad showing two different means of securing the flap around a portion of a vertical slat.
Figure 6:
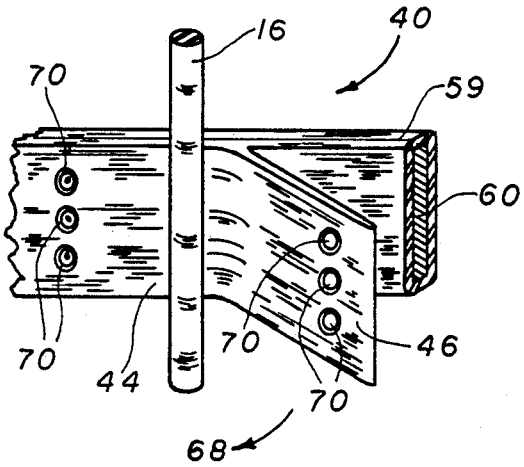

In FIG. 5, a portion of the assembled bumper pad 40 is shown with a flap 46 in an open position ready to be wrapped around a vertical slat 16 as indicated by an arrow 68. In this illustration the velcro attachment strips 64 are used for securing the flap 46 to the exterior side 44 with the slat 16 therebetween. In FIG. 6, a similar view of the bumper pad 40 is shown with the attachment strips 64 replaced with metal snaps 70. While the attachment strips 64 and snaps 70 are shown in the drawings, it can be appreciated that various other types of attachment devices could be used for securing the flap 64 adjacent the exterior side 44 as shown.

Figure 7:
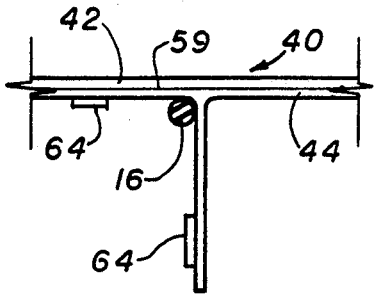
FIG. 7 and FIG. 8 are top views of a portion of the bumper pad showing the flap in an open position and in a closed secured position around a vertical slat.
Figure 8:
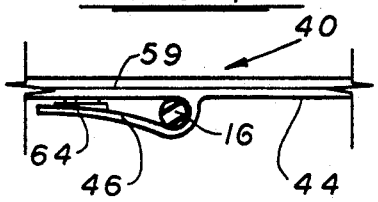

In FIG. 7, a top view of one of the bumper pad's flap 46 is shown and similar to the view shown in FIG. 5. In this view the vertical slat 16 is shown in cross section with the flap 46 in an open position. In FIG. 8, a top view of the flap 46 is shown with the flap 46 wrapped around the slat 16 with the flap 46 secured to the exterior side 44.

Figure 10:
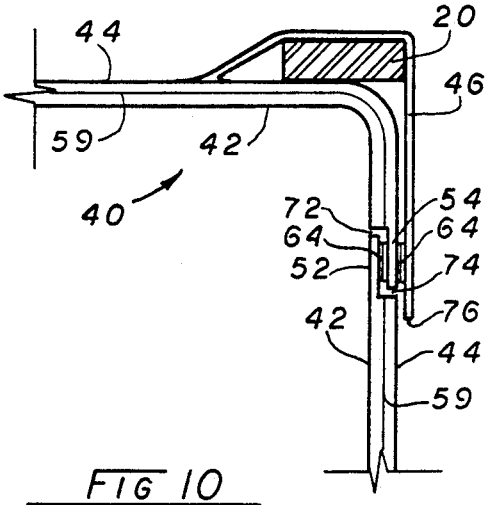
FIG. 10 is a top view of a portion of the bumper pad attached to a corner post and illustrating the first end and the second end of the bumper pad secured together with the pad forming a closed loop.

In FIG. 9, a perspective view of the first end 52 and the second end 54 of the bumper pad 40 is shown. Both the first end 52 and second end 54 are tapered by having a portion of the padding 60 removed so that when the ends are secured together the overall thickness of the pad 40 remains the same. This feature can be seen in FIG. 3 and FIG. 10. The only departure from the interior side 42 and exterior side 44 being one continuous flat surface is a vertical interior break line 72 and a vertical exterior break line 74 where the ends 52 and 54 meet. The two break lines 72 and 74 are shown in FIG. 10. The ends 52 and 54 are releasably secured together using the strips 64 of attachment material similar to the strips 64 seen in FIGS. 4–5. As mentioned above, the use of the attachment strips 64 is but one of many ways of securing the first end 52 and second end 54 together. Also shown in FIG. 9 is a corner post flap 46 integrated into the exterior side 44 and disposed next to the second end 54.

In FIG. 10 a top view of the pad 40 is shown with a corner of the pad 40 received adjacent one of the crib's corner post 20, which is seen in cross section. In this view, the first end 52 and the second end 54 of the pad 40 are secured together. The securing of the ends 52 and 54 come together in a hidden manner near the corner post 20. This is by design, so that the vertical interior break line 72 is as far removed as possible from the sight of a playful child, who may wish to explore the separating of the two ends 52 and 54 of the pad 40. Also, shown in this drawing is one of the corner flaps 46 wrapped around a portion of the corner post 20 with the end of the flap 46 attached to the exterior side 44. An end 76 of the flap 46 is used to conceal the vertical exterior breakline 74 for providing more pleasing lines when viewing the bumper pad 40 from outside the infant crib 18.

In the above drawings, the bumper pad 40 has been shown with the flaps 46 integrated into the exterior side 44 so that the flaps 46 can not be torn free during the use of the pad 40. While this embodiment of the integrated flaps 46 is preferred, it is acknowledged that the flaps 46 can also be made independently of the exterior and interior sides 44 and 42 and than sewn along the vertical width of the exterior side 44 and in a spaced relationship to each other as discussed above.

The embodiments of the invention for which an exclusive privilege and property right is claimed are defined as follows:

1. A bumper pad for receipt inside an infant crib and attachment to vertical slats and vertical corner posts of the crib, the bumper pad disposed inside the crib and adjacent the top of a crib mattress, the bumper pad designed to protect babies, infants and small children when using the crib, the bumper pad comprising:

an elongated interior side and an oppositely disposed exterior side, the exterior side disposed next to the slats and corner posts; and a plurality of flaps extending outwardly from said exterior side of the pad, said flaps disposed in a spaced relationship to each other around said exterior side of the pad, said flaps used to wrap around a portion of selected crib's slats and the corner posts for securing the pad to the crib and adjacent the mattress of the crib, said flaps formed in a fabric facing material by gathering the facing material in a loop and stitching the material vertically adjacent said exterior side.

2. The bumper pad as described in claim 1 further including a first end of the pad releasably secured to a second end of the pad for forming a closed loop.

3. The bumper pad as described in claim 1 wherein said interior and exterior sides each include an upper portion and a lower portion joined together to form a void therebetween, said void used for receiving padding material therein.

4. The bumper pad as described in claim 1 wherein said flaps are disposed on said exterior side in a space relationship for receipt around a portion of four corner posts and around a portion of at least one vertical slat on each side of the crib.

5. The bumper pad as described in claim 1 wherein said flaps each have a releasable securing means attached to an end of said flap for securing said flap to a portion of said exterior side.

6. A bumper pad for receipt inside an infant crib and attachment to vertical slats and vertical corner posts of the crib, the bumper pad disposed around the interior perimeter of the crib and adjacent the top of a crib mattress, the bumper pad designed to protect babies, infants and small children when using the crib, the bumper pad comprising:

an elongated interior side and an oppositely disposed exterior side disposed next to the slats and corner posts;

a first end of the pad releasably secured to a second end of the pad for forming a closed loop, said first end of the pad and said second end of the pad tapered so that when said ends are releasably secured, the thickness of said joined ends is the same as the thickness of the pad; and at least one flap attached to a fabric facing material of said exterior side, said flap extending outwardly from said exterior side of the pad; said flap used to wrap around a portion of the crib's slat or the corner post for securing the pad to the crib and adjacent the mattress of the crib.

7. The bumper pad as described in claim 6 wherein said interior side and said exterior side each include an upper portion and a lower portion joined together and sewn to form a void therebetween, said void used for receiving padding material therein.

8. The bumper pad as described in claim 6 wherein the pad includes a plurality of flaps extending outwardly from said exterior side of the pad, said flaps disposed in a spaced relationship to each other around said exterior side of the pad and disposed adjacent the four corner posts of the crib and adjacent at least one vertical slat on each side of the crib, said flaps used to wrap around a portion of the crib's slats and the corner posts for securing the pad to the crib and adjacent the mattress of the crib.

9. The bumper pad as described in claim 8 wherein said flaps are integrated into a fabric facing material making up said exterior side of the pad.

10. The bumper pad as described in claim 9 wherein said flaps are formed in the fabric facing material by gathering the facing material in a loop and stitching the material vertically adjacent said exterior side.

11. The bumper pad as described in claim 8 wherein said flaps each have a releasable securing means attached to an end of said flap for securing said flap to a portion of said exterior side.

12. The bumper pad as described in claim 8 wherein the pad includes a plurality of flaps independently attached to said exterior side and extending outwardly from said exterior side of the pad, said flaps disposed in a spaced relationship to each other around said exterior side of the pad, said flaps used to wrap around a portion of selected crib's slats and the corner posts for securing the pad to the crib and adjacent the mattress of the crib.

13. The bumper pad as described in claim 6 wherein said first end and said second end have a releasable securing means attached thereto for releasably securing said first end to said second end.

14. A bumper pad for receipt inside an infant crib and attachment to vertical slots and vertical corner posts of the crib, the bumper pad disposed inside the crib and adjacent the top of a crib mattress, the bumper pad having a width wherein the width of the bumper pad is disposed adjacent the vertical slats and vertical corner posts of the crib, the bumper pad designed to protect babies, infants and small children when using the crib, the bumper pad comprising:

an elongated interior side and an oppositely disposed exterior side disposed next to the slats and corner posts; and at least one flap attached to a fabric facing material of said exterior side, said flap extending outwardly from said exterior side of the pad, said flap used to wrap around a portion of the crib's slat or the corner post for securing the pad to the crib and adjacent the mattress of the crib, said flap having a width approximate to the width of the bumper pad for providing greater stability in holding the bumper pad securely to the crib's slat or the corner post.

15. The bumper as described in claim 14 wherein said interior side and said exterior side each include an upper portion and a lower portion joined together and sewn to form a void therebetween, said void used for receiving padding material therein.

16. The bumper bad as described in claim 14 wherein the pad includes a plurality of flaps extending outwardly from said exterior side of the pad, said flaps disposed in a spaced relationship to each other around said exterior side of the pad and disposed adjacent the four corner posts of the crib and adjacent at least one vertical slat on each side of the crib, said flaps used to wrap around a portion of the crib's slats and the corner posts for securing the pad to the crib and adjacent the mattress of the crib.

17. The bumper pad as described in claim 16 wherein said flaps are integrated into a fabric facing material making up said exterior side of the pad.

18. The bumper pad as described in claim 17 wherein said flaps are formed in the fabric facing material by gathering the facing material in a loop and stitching the material vertically adjacent said exterior side.

* * * * *